US005966979A

United States Patent [19]

Del Fabro et al.

[11] Patent Number: 5,966,979

[45] Date of Patent: Oct. 19, 1999

[54] BENDING MACHINE AND METHOD HAVING POSITIONABLE DRAWING ROLLS AND LIMITING MECHANISM DEFINING A TRANSIT AND CONTAINING SPACE FOR THE WORKPIECE

[75] Inventors: Marcello Del Fabro, Udine; Giorgio Del Fabro, Tricesimo, both of Italy

[73] Assignee: M.E.P. Macchine Elettroniche Piegatrici SpA, Reana Del Rojale (UD), Italy

[21] Appl. No.: 09/065,455

[22] Filed: Apr. 24, 1998

[30] Foreign Application Priority Data

Apr. 29, 1997 [IT] Italy ..... UD97A0082

[51] Int. Cl.[6] ..... B21D 7/024

[52] U.S. Cl. ..... 72/294; 72/307

[58] Field of Search ..... 72/307, 294, 306, 72/217–219, 387, 388

[56] References Cited

U.S. PATENT DOCUMENTS

| | | | |
|---|---|---|---|
| 3,263,471 | 8/1966 | Martin | 72/294 |
| 3,584,660 | 6/1971 | Pain | 72/307 |
| 4,590,779 | 5/1986 | Stange | 72/294 |
| 5,195,348 | 3/1993 | Del Fabro | 72/294 |
| 5,375,447 | 12/1994 | Del Fabro | 72/307 |
| 5,511,402 | 4/1996 | Kauffman | 72/307 |

FOREIGN PATENT DOCUMENTS

| | | | |
|---|---|---|---|
| 374465 | 6/1990 | European Pat. Off. . | |
| 537496 | 4/1993 | European Pat. Off. . | |
| 538595 | 4/1993 | European Pat. Off. . | |
| 126321 | 9/1980 | Japan | 72/217 |
| 336349 | 4/1959 | Switzerland . | |

*Primary Examiner*—Daniel C. Crane

*Attorney, Agent, or Firm*—Antonelli, Terry, Stout & Kraus, LLP

[57] ABSTRACT

Perfected bending system for bending machines including a working plane (19) cooperating with at least a drawing device (12) including one or more pairs of rolls (15), the rolls (15) having at least a working position ("I") wherein they are closed on the round piece (11) in order to feed it forward, the drawing device (12) cooperating with at least one bending assembly (13*b*) arranged downstream thereof and with at least one shearing assembly (14), the system providing that, at the end of the feeding and positioning step of the round piece (11) in correspondence with the relative bending assembly and before the bend is made, the rolls (15) of the drawing device (12) are temporally arranged in an open position ("II") where they do not interfere laterally and are not in contact with the round piece (11) so as to allow the already bent portion located beyond the bending assembly to fall onto the working plane (19), returning subsequently to the closed working position ("I") before the bending is carried out.

11 Claims, 1 Drawing Sheet

BENDING MACHINE AND METHOD HAVING POSITIONABLE DRAWING ROLLS AND LIMITING MECHANISM DEFINING A TRANSIT AND CONTAINING SPACE FOR THE WORKPIECE

FIELD OF APPLICATION

This invention concerns a perfected bending system for bending machines.

The system is applied in machines used for the bending and shaping of metal shapes, particularly, but not only, of round pieces used for reinforcement purposes in constructions of reinforced concrete.

Particularly, but not exclusively, the invention is applied in bending and/or shaping machines with a horizontal or substantially horizontal working plane.

Hereinafter, for simplicity of explanation, we shall refer to bending machines for round pieces, but the invention may be applied to any kind of bending/shaping machine whatsoever.

Moreover, hereinafter we shall refer to round piece, but the section of the metal bar may be of various types, such as three-lobed, square, hexagonal, oval, etc.

STATE OF THE ART

The state of the art covers bending machines for round pieces for reinforcement purposes comprising at least a drawing assembly associated with at least a bending assembly and with a shearing assembly used to make brackets and/or bars shaped according to pre-defined angular or polygonal geometries.

The drawing assembly normally comprises at least a drawing device consisting of one or more pairs of counter rotating rolls aligned on a perpendicular axis with respect to the longitudinal axis of the round piece in transit.

In the case of round pieces fed from a reel, the drawing assembly normally also comprises straightening means placed upstream, downstream or both upstream and downstream of the drawing device.

In such bending machines, the round piece is often subject to rotations and lengthwise torsions along its axis which may cause considerable problems in the subsequent bending step.

This tendency to rotate and/or twist on its on axis derives from many factors such as rolling, winding, unwinding, pressure of the drawing rolls, etc.

Another cause which accentuates the structural tensions and problems relating to the drawing of the round piece is that the shape of the section is not constant.

There are sections where the round piece becomes almost oval in section, or at least where there are variations in the section, and this causes drawing problems which produce further axial twisting of the round piece as it advances. The axial twisting or rotation of the round piece have their effect on the position of the bends already made, as these tend to modify their position and lie at an angle on the working plane of the machine.

In other words, the bends already made tend to become detached and rise up with respect to the working plane of the machine as the round piece, as it is fed forwards in order to make the subsequent bends, gradually tends to twist and rotate on its axis.

The angular modifications to the plane on the already formed bends lie make it extremely difficult to obtain a correctly shaped product, and therefore to correctly position the first formed bends on the same plane as those made subsequently; this causes the formation of shaped brackets or bars which are inferior in quality because they are not planar.

Therefore it is very often necessary to discard these products and repeat the operations to form them, which causes a considerable increase in production costs and times.

In order to solve these problems, various solutions have been proposed, but they have not been efficacious, as they need complex and bulky equipment or require very high driving forces, with a consequent increase in production and/or management costs of the bending machines.

The state of the art includes CH-A-336349 which describes a device to form stirrups for reinforcement purposes; the device comprises in sequence a straightening device consisting of two series of rollers orthogonal to each other, a drawing device including rollers which feeds step-by step the wire which is to be bent, a shears, two bending assemblies and a device to discharge the stirrups when they are formed.

The drawing device is located upstream of the bending assemblies and is associated with a cam mechanism. Therefore, during the feed step, the rollers press on the wire to be drawn with great pressure (FIG. 3) whereas, during the bending step, they are only in contact with the wire (FIG. 5).

However, since the drawing device is upstream of both the bending assemblies, and since the rollers are arranged in contact with the wire during the bending step, the wire itself is not able to rotate and fall on the working plane if an angular modification of its position occurs as the bending operations proceed.

Moreover, there are no means to limit the lifting of the wire during bending and prevent it from turning over if the lifting of the bent portion is more than 90° with respect to the working plane.

The teachings of this document, therefore, do not obviate the shortcomings described above.

The present applicant has tested and embodied this invention to overcome these shortcomings and to achieve further advantages.

DISCLOSURE OF THE INVENTION

The purpose of the invention is to provide a perfected bending system, to be applied to bending machines for round pieces, advantageously but not only round pieces for reinforcement purposes, and to other types of bending machines, which will allow the twisting movements made by the round piece to be recovered and so that all the bends lie substantially on the same plane.

A further purpose of the invention is to provide a system which will allow shaped brackets and bars of high quality to be made, characterised by great planarity, without modifying substantially the basic structure of the bending machine.

The bending system according to the invention uses a bending machine of a substantially conventional type comprising a drawing device, consisting of one or more pairs of rolls, cooperating with at least a bending assembly and a mating shearing assembly.

In the event that the machine has two bending assemblies to make bends upstream and downstream, the drawing device is arranged at an intermediate position between the two bending assemblies.

According to the invention, the bending machine, downstream of the bending assembly and substantially on the same axis as the axis of feed of the round piece, has an element to limit the lift of the front part of the round piece which has already been bent.

The limiting element is arranged above the plane on which the round piece lies as it passes, and defines between itself and the working plane of the machine a vertical transit space which is little more than the size of the section of the round piece.

The transit space defined by the limiting element can also have a height coherent with two round pieces or more, according to the applications and the number of round pieces bent at the same time.

In the preferred embodiment, the limiting element consists of a metallic body, flat or shaped, and extending for a certain lengthwise section above the working plane of the machine, or the bending plane of the round piece which is to be shaped.

According to a variant, the limiting element is associated with actuating means which can lift it to different heights with respect to the bending plane of the round piece, and can possibly discharge it from the transit seating of the round piece.

This solution is particularly advantageous because it is possible thereby to adapt the arrangement of the limiting element to the number of round pieces which are to be bent simultaneously. This solution moreover makes it possible to extract the shaped round piece more easily when bending is concluded, and to carry out maintenance operations on the bending machine with greater facility.

When the round piece is fed, it is at least partly contrasted, in its tendency to rotate and twist on its axis, due to the interference which the limiting element arranged above the working plane of the machine and at a defined height therefrom, exerts on the bend or bends already made.

This contrast causes the section of the round piece which has already been bent downstream of the drawing device to be maintained in a position of substantial proximity to the working plane of the machine.

According to the invention, at the end of the feeding step which precedes one or more bending steps, according to the requirements which arise from time to time, the rolls of the drawing device, and possibly the other gripping and/or contrasting elements acting on the round piece, are opened and removed from the round piece, thus stopping, at least for a moment, the clamping action and lateral contrast on the round piece.

When the clamping and contrasting action on the round piece is interrupted, this causes the already made and partially lifted bends to fall, due to their own weight, onto the working plane of the machine, where they therefore tend to assume a planar position resting on the working plane.

The bends falling cause the round piece which still has to be bent to be taken back to its correct position on the working plane, since the presence of the limiting device located above prevents it from lifting more than 90° with respect to the working plane and therefore prevents it from overturning.

Having obtained this effect, the rolls of the drawing device and the other possible gripping and contrasting means are closed on the round piece so that the cycle can continue.

The drawing device may open and close on the round piece before each bend, or for some of them, according to the type of round piece being worked and/or the type of product to be obtained.

The system according to the invention makes it possible to obtain shaped brackets and/or bars with a high level of planarity by using simple equipment without modifying the general structure of the machine and without reducing productivity.

ILLUSTRATION OF THE DRAWINGS

The attached Figures are given as a non-restrictive example and show a preferential embodiment of the invention as follows:

FIG. 1 shows a diagram of a bending machine using the perfected bending system according to the invention;

FIG. 2 shows a section from A to A of FIG. 1;

FIG. 3 shows a section from B to B of FIG. 2.

DESCRIPTION OF THE DRAWINGS

The reference number 10 in the figures denotes generally the bending machine for round pieces 11 for reinforcement purposes using the perfected bending system according to the invention.

The following description describes the case where the bending machine 10 works a single round piece 11 at a time, but it is the same case when several round pieces 11 are worked together, one on top of the other.

Figure 1:
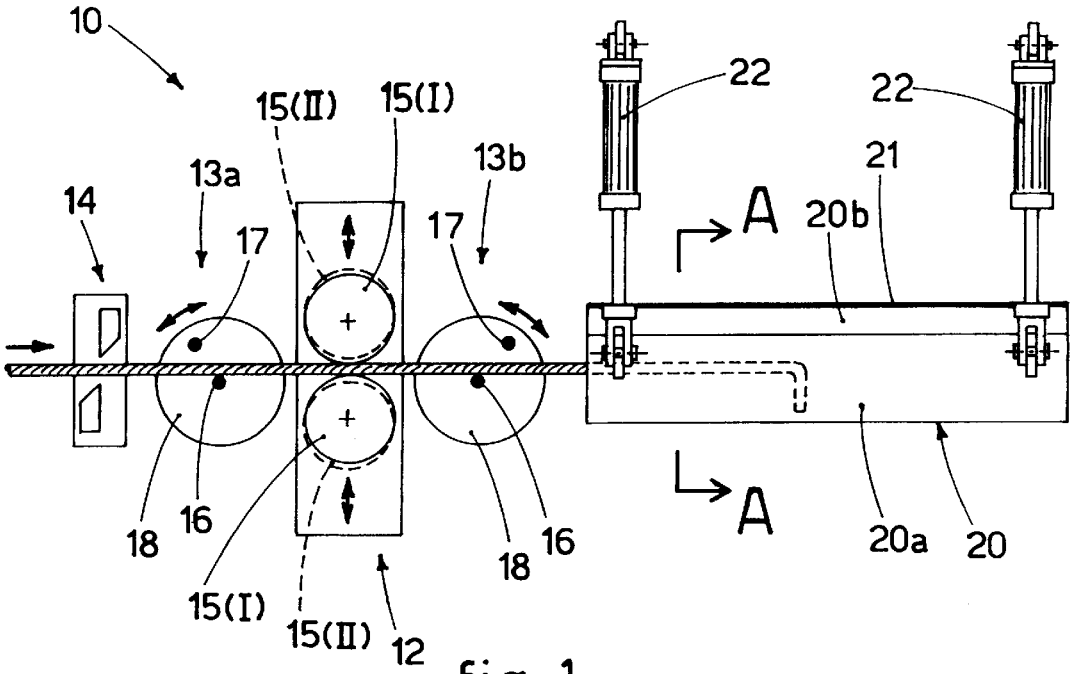
Figure 2:
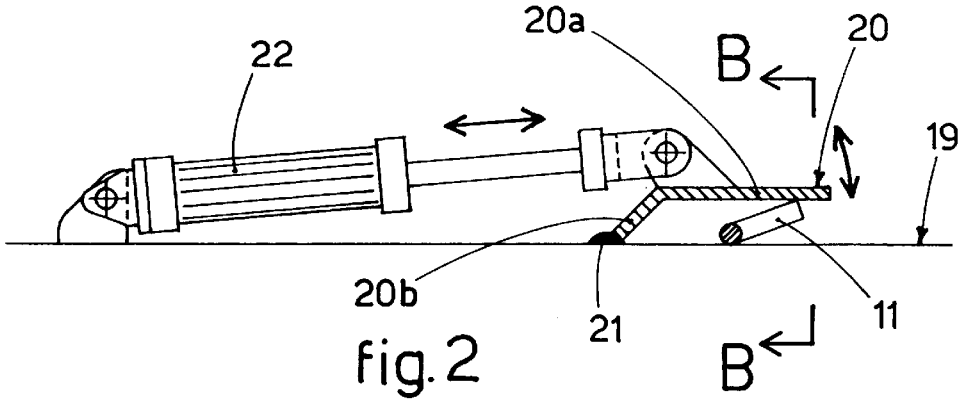
Figure 3:
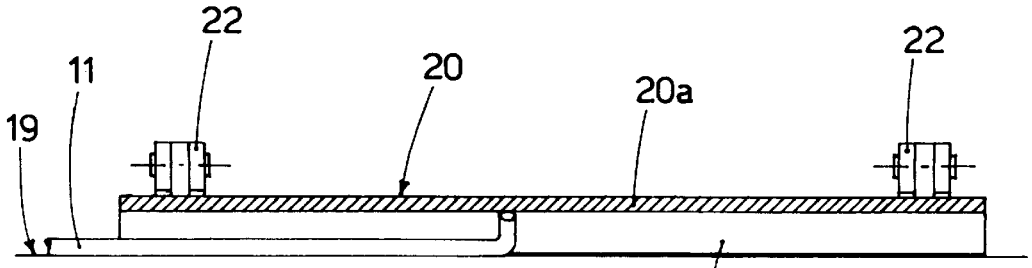

The bending machine 10 is equipped with a drawing device 12 comprising a pair of rolls 15 arranged aligned substantially perpendicular to the round piece 11 in transit.

In this case, the drawing device 12 cooperates with two bending assemblies, the first 13*a* and the second 13*b*, arranged respectively upstream and downstream thereof, and with a shearing assembly 14 arranged upstream of the first bending assembly 13*a*.

The bending assemblies 13*a*, 13*b* shown are of the type with a rotary plate 18 and include a contrasting pin 16 and a bending pin 17.

The bending machine 10 comprises, in this case, a limiting element 20 which extends lengthwise, substantially on an axis with the round piece 11 which is to be bent, and for a defined section, downstream of the second bending assembly 13*b*.

The limiting element 20 lies on a plane at a desired height above the working plane 19 of the machine 10, or the bending plane of the round piece 11.

In this case, the limiting element 20 consists of a metal shape of an open section comprising an upper face 20*a* and a side face 20*b*.

According to variants which are not shown here, the limiting element 20 has a transverse section which may be arched, rectangular or of another desired shape.

The limiting element 20, in this case, pivots horizontally with respect to the working plane 19, in correspondence with its side face 20*b*, by means of a hinge 21.

In the embodiment shown here, the movement of the limiting element 20 is obtained by means of two actuators 22 hinged at one end to the upper face 20*a* of the limiting element 20 and at the other end to the working plane 19.

At the beginning of the operative cycle, the rolls 15 of the drawing device 12 cause the round piece 11 to advance until it reaches the positions programmed for the first bends to be made.

At this stage, the rolls 15, in position "I", exert a high compression on the round piece 11; this compression, because of the structural tensions which have been accumulated by the round piece 11, tend to make it twist and rotate on its axis.

The axial twists and rotation cause the bends which have already been made to rise up, downstream of the drawing device 12.

In this case, the lifting of the bends which have already been made is contained by the limiting element 20 as the upper face 20*a* of the limiting element 20 comes into contact with the section of round piece 11 which has already been bent.

This limits the lifting action of the round piece 11 and maintains the already bent section of the round piece at a level near to the working plane 19, or in any case less than 90° with respect to the working plane and such as to prevent it from turning over.

Since the position of the limiting element 20 is adjustable, it is possible to adapt the position thereof to the step and/or the type of bending to be carried out, or also to the bulk of the bends already made; it also allows the limiting element 20 to be discharged from the line of transit of the round piece 11 so that the final product obtained may be extracted more easily or for maintenance operations to be carried out.

At the end of the feed and positioning of the round piece 11 which precedes bending, the rolls 15 of the drawing device 12 are taken from the position "I", where they are closed over the round piece 11, to a partially open position "II" (shown by a line of dashes) wherein they are taken to a position of non-contact and therefore release the round piece 11.

Any contrasting and/or gripping means placed upstream or downstream of the drawing device 12 also open so as to completely release the round piece 11 from lateral contact.

This lateral release causes the section of round piece 11 which has already been bent to fall due to its own weight, downstream of the drawing device 12, which is therefore returned to a resting position on the working plane 19 of the machine 10.

Before the bend is made, the rolls 15 are repositioned in the closed position "I" so as to clamp the round piece 11, thus acting as a contrast to the bending, and then, once bending has been completed, so as to draw it into the position corresponding to the next bending.

This procedure, of opening and then closing the rolls 15 on the round piece 11, can be carried out before all the bends, or only before some of them, according to the type of round piece 11, the type of feed (from a reel, in bars, etc.), the uniformity of the section of the round piece 11, its provenance, the type of final product which is to be obtained, etc.

We claim:

1. A bending machine employed for the shaping of metal pieces, the bending machine having a working plane on which at least one metal piece is advanced, comprising a drawing device including at least one pair of rolls, at least one bending assembly arranged downstream of the drawing device, and at least one shearing assembly, wherein the rolls of the drawing device have a closed working position ("I") closed on the at least one metal piece in order to feed the at least one metal piece, and an open position ("II") in which the rolls are arranged at the end of feeding and positioning of the at least one metal piece to the at least one bending assembly and before the bend is made, wherein the rolls of the drawing device in the open position ("II") do not interfere laterally and are not in contact with the metal piece so as to allow a portion which is already bent and located after the bending assembly to fall onto the working plane, and wherein the rolls can return subsequently to the closed working position ("I"), so as to act as a contrasting element to the bending, before the at least one bending assembly acts on the at least one metal piece.

2. A bending machine as in claim 1, further comprising at least a limiting element arranged downstream of the at least one bending assembly, the limiting element being arranged substantially on an axis with the metal piece which is to be bent and including at least an upper face lying for a lengthwise segment on a plane at a defined height above the working plane of the bending machine and defining between it and the working plane a transit and containing space for the metal piece which is to be bent and for the at least one bend defined therein.

3. A bending machine as in claim 2, in which the upper face of the limiting element is arranged at least temporally substantially parallel to the working plane of the bending machine.

4. A bending machine as in claim 2, in which the limiting element has an arched transverse development.

5. A being machine as in claim 2, in which the limiting element has a substantially rectangular transverse development.

6. A bending machine as in claim 2, in which the limiting element is constrained pivoting horizontally with respect to the working plane.

7. A bending machine as in claim 2, in which the height of the limiting element can be adjusted with respect to the working plane.

8. A bending machine as in claim 2, in which the limiting element is associated with actuators to move and/or discharge the limiting element with respect to the working plane.

9. A bending machine employed for the shaping of metal pieces, the bending machine having a working plane on which at least one metal piece is advanced, comprising a drawing device including at least one pair of rolls, at least one bending assembly arranged downstream of the drawing device, at least one shearing assembly, and a limiting element arranged downstream of the at least one bending assembly, the limiting element being arranged substantially on an axis with the metal piece which is to be bent and including at least an upper face lying for a lengthwise segment on a plane at a defined height above the working plane of the bending machine and defining between it and the working plane a transit and containing space for the at least one metal piece which is to be bent and for the at least one bend defined therein.

10. A method for shaping metal pieces, comprising:

rotating opposed rolls of a drawing device to advance at least one metal piece compressed therebetween on a working plane of a bending machine, making a plurality of bends in the at least one metal piece while the at least one metal piece is compressed between the opposed rolls of the drawing device, and before making at least one of the plurality of bends, at least partially opening the rolls of the drawing device to an open position in which the rolls do not interfere laterally and are not in contact with the at least one metal piece to allow the at least one metal piece to fall onto the working plane, and then closing the rolls to compress the at least one metal piece therebetween.

11. A method as in claim 10, further comprising limiting lifting of the at least one metal piece with a limiting element arranged downstream of the at least one bending assembly, the limiting element being arranged substantially on an axis with the at least one metal piece which is to be bent and including at least an upper face lying for a lengthwise segment on a plane at a defined height above the working plane of the bending machine and defining between it and the working plane a transit and containing space for the at least one metal piece which is to be bent and for the at least one bend defined therein.

* * * * *